United States Patent [19]

Tanaka et al.

[11] Patent Number: 4,695,484

[45] Date of Patent: Sep. 22, 1987

[54] PROCESS FOR FORMING MOISTURE-PERMEABLE WATERPROOF COATING ON FABRICS

[75] Inventors: Teruo Tanaka; Teruya Tanaka, both of Ohmihachiman; Masato Kitamura, Kyoto, all of Japan

[73] Assignee: Dai-Ichi Kogyo Seiyaku Co., Ltd., Kyoto, Japan

[21] Appl. No.: 805,520

[22] Filed: Dec. 6, 1985

[30] Foreign Application Priority Data

Dec. 7, 1984 [JP] Japan ..... 59-259743

[51] Int. Cl.[4] ..... B05D 3/02; B05D 3/10; B05D 5/00

[52] U.S. Cl. ..... 427/245; 427/338; 427/339; 427/342; 435/263

[58] Field of Search ..... 435/262, 263, 317; 427/244, 245, 342, 338, 339

[56] References Cited

U.S. PATENT DOCUMENTS 2,673,825 3/1954 Biefeld et al. ..... 427/245 X

FOREIGN PATENT DOCUMENTS 151179 10/1981 German Democratic Rep. ..... 435/262

*Primary Examiner*—Evan K. Lawrence

*Attorney, Agent, or Firm*—Millen & White

[57] ABSTRACT

A moisture-permeable waterproof coating is formed by coating a fabric with a water-based coating composition containing a film forming polymer and a water-soluble polymer in a proportion of 5 to 70% based on total solids, drying or heating the fabric to form a film thereon; and then treating the resulting film with an aqueous solution of an enzyme which selectively degrades the water-soluble polymer, thereby enzymatically degrading the water-soluble polymer and extracting the degraded water soluble polymer from the film, whereby the film on the fabric is rendered microporous.

20 Claims, No Drawings

PROCESS FOR FORMING MOISTURE-PERMEABLE WATERPROOF COATING ON FABRICS

BACKGROUND OF THE INVENTION

This invention relates to a method for forming a moisture-permeable waterproof coating on fabrics.

Many different methods have been proposed for forming a moisture-permeable waterproof coating on fabrics. Most of known methods may be classified as a "wet coagulation process" in which a solution of a film-forming polymer in a water-miscible solvent is applied on a fabric followed by immersing the fabric in a water bath to coagulate the polymer into a microporous coating layer. Other known methods include the so-called "dry coagulation process" which utilizes a coating composition containing a blowing agent which generates a gas such as $N_2$ or $CO_2$ upon heating, or a pore-forming agent which may be leached out with water. Another known method comprises the steps of providing an aqueous emulsion of a film-forming elastomer, vigorously whipping the emulsion, applying the resulting whipped emulsion on a fabric and then drying.

All of these known methods, however, suffer from a common disadvantage that the pore size of the resulting water-proof coating layer varies to a great extent and thus it is difficult to control the pore size within a relatively uniform distribution range at which both waterproofness and moisture-permeability are compatible. Furthermore, the solvent-based dry coagulation process requires a large investment in systems for solvent recovery and the like.

It is therefore an object of this invention to provide an improved method for forming a moisture-permeable water-proof coating on a fabric which is free from the above-mentioned disadvantages. More particularly, the invention provides an improved method for manufacturing a moisture-permeable waterproof fabric with improved feeling and increased resistance to laundering and dry cleaning using a water-based waterproofing coating composition.

SUMMARY OF THE INVENTION

According to the present invention, there is provided a method for forming a moisture-permeable waterproof coating on a fabric which comprises the steps of providing a water-based coating composition containing a film-forming polymer and a water-soluble polymer in a proportion of 5 to 70% by weight of the total solid content of said coating composition, applying said coating composition on a fabric, drying or heating said fabric to form a film thereon, and then treating the film with an enzyme, e.g., by immersing the fabric in a water bath containing the enzyme, capable of selectively degrading said water-soluble polymer, thereby enzymatically degrading the water-soluble polymer and extracting the degraded water soluble polymer from the film, whereby the film on the fabric is rendered microporous.

DETAILED DESCRIPTION OF THE INVENTION

Water-soluble polymers such as starch have been used as a pore-forming agent for producing microporous film on a fabric. However, since they are incorporated as solid particles into a coating composition and leached out with water, the pore size of the resulting film is mainly controlled by the size of the polymer particles initially present in the film.

It has been surprisingly discovered that a moisture-permeable waterproof coating may be formed by coating a fabric with a water-based coating composition containing a water-soluble polymer and then treating the resulting film with an enzyme which selectively degrades the water-soluble polymer. The resulting film has a relatively uniform pore-size distribution ranging from about 1 10 microns, which is the range at which both high moisture-permeability and high waterproofness are compatible. Some of the micropores have a three-dimentional configuration which may contribute to a flexible feeling of the coated fabric.

As a basic film-forming composition, any conventional water-based elastomeric composition may be used. Examples thereof include acrylic emulsions, polyurethane emulsions, polyvinyl acetate emulsions, silicone emulsions, natural and synthetic latices, thermally reactive water-soluble polyurethanes and mixtures of these compositions.

The water-soluble polymer to be incorporated into the basic coating composition may be any water-soluble polymer which is degraded by the action of an enzyme specific therto. Examples thereof include starch, dextrin, carboxymethylstarch, sodium alginate, carboxymethylcellulose, hydroxyethylcellulose, locust bean gum, guar gam, tamarind gum, water-soluble proteins and water soluble derivatives of these polymers.

The proportion of water-soluble polymer in the coating composition may vary depending upon intended uses and generally ranges from 5 to 70%, preferably from 10 to 50% by weight of the total solid content of the coating composition.

The coating composition may contain other conventional additives such as silicone or fluorocarbon water repellents, thickening agents and the like.

It is preferable that these components be selected so that the resulting coating composition is stable upon storage and gives a waterproof coating having a flexible feeling.

The amount of coating composition to be applied on the fabric is not critical but geneally ranges from 5 to 400 $g/m^2$, preferably from 10 to 200 $g/m^2$ on dry basis.

Any fabric made of various synthetic or natural fibers such as nylon, polyester, acrylic, acetate, cotton, linen, wool and mixtures of these fibers may be processed in accordance with the method of this invention. These fabrics preferably are pretreated with a conventional water repellent such as silicone or fluorocarbon water repellents to improve the water repellency of resulting fabrics.

After application of the coating composition, the fabric is heated to form a film thereon and then immersed in a water bath containing an enzyme which selectively degradates the water-soluble polymer. By this treatment, the water-soluble polymer present in the film is degraded into low molecular weight products and extracted out of the film with the water.

Various enzymes are known and commercially available which selectively act upon appropriate water-soluble polymers. Examples thereof include cellulose acting on cellulose and its derivatives, amylase acting on starch and its derivatives, protease acting on proteins, alginase acting on alginates, carboxymethylcellulose acting on CMC and the like.

The concentration of enzyme in the water bath varies with the content of water-soluble polymer and generally ranges from 0.1 to 2.0% by weight. The temperature and pH of the enzyme solution should, of course, be adjusted at an optimal range for particular enzymes. The length of immersion time is not critical but generally ranges from 5 to 30 minutes. The enzyme solution may contain a surfactant, an inorganic builder, an alkali, an acid or a water-miscible solvent in order to promote the extraction of water-soluble polymer provided that the presence of these solubilizing agents does not inhibit the enzyme activity.

The enzyme may also be incorporated into the coating composition as desired. In this case, the enzyme may be deactivated upon heating and thus the treatment with enzyme must be carried out as usual.

After treating with the enzyme solution, the fabric is thoroughly washed, dried and, if desired, treated with a water repellent to further improve the water repellency of the resulting fabric.

The fabric made by the method of this invention may find its uses in various fields such as sport wears, rain coats, tents, bags, shoes diaper covers and other product lines where moisture-permeability is required in addition to waterproofness.

The following examples illustrate the invention. All parts and percents therein are by weight.

EXAMPLE 1

A nylon taffeta fabric was immersed in a 2% aqueous solution of ELASGUARD 100 (fluorocarbon, water repellent sold by DAI-ICHI KOGYO SEIYAKU CO., LTD.), squeezed by a mangle machine and heat-treated at 120° C. for 3 minutes.

A coating composition consisting of:

| | |
|---|---|
| ELASTRON CT-7 (thermally reactive water-soluble polyurethane sold by DAI-ICHI KOGYO SEIYAKU CO., LTD.) | 30 parts |
| M-2010 (modified polyurethane emulsion sold by DAI-ICHI KOGYO SEIYAKU CO., LTD.) | 30 parts |
| POLON MF-5 (silicone emulsion sold by SHIN-ETSU CHEMICAL CO., LTD.) | 5 parts |
| ELASTRON CAT 32 (organotin catalyst sold by DAI-ICHI KOGYO SEIYAKU CO., LTD.) | 1 parts |
| 32% aqueous solution of FINEGUM HEL (CMC sodium sold by DAI-ICHI KOGYO SEIYAKU CO., LTD.) | 30 parts |

was applied uniformly on the fabric by a roll center in a coating amount of 30 g/m$^2$ on dry basis. Then the fabric was heat-treated at 130° C. for 4 minutes.

The fabric was soaked in water at ambient temperature for about 1 minute, transferred into a bath consisting of a 0.3% aqueous solution of ENZYLON CA-40 (enzyme cellulase sold by RAKUTO KASEI KOGYO CO., LTD.) and soaked therein at 50° C. for about 20 minutes with occasional stirring. After treating with the enzyme solution, the fabric was soaked in a water bath having a temperature of 80° C. to deactivate the enyzme, washed with water thoroughly and dried. The resulting fabric was subjected to a post-water repellent treatment using a composition containing 5% of ELASGUARD 100, 5% of D-1009-5 (polyurethane cross-linker sold by DAI-ICHI KOGYO SEIYAKU CO., LTD.) and 0.1% ELASTRON CAT 32.

Physical properties of the resulting fabric are shown in Table I.

As a control, the same treatment was repeated except that the water-soluble polymer was extracted out using plain water free frm the enzymes having a temperature of 40° C. Table I also shows physical properties of this control fabric.

TABLE I

| | Fabric | |
|---|---|---|
| | Treated with enzyme | Treated with plain water |
| Moisture-permeability[1] (g $H_2O/m^2 \cdot 24$ hrs.) | | |
| Immediately after treatment | 5500 | 3500 |
| After laundering[3] | 5300 | 3600 |
| After dry cleaning[4] | 5500 | 3500 |
| Waterproofness[2] (mm $H_2O/cm^2$) | | |
| Immediately after treatment | 1000 | 550 |
| After laundering | 950 | 480 |
| After dry cleaning | 850 | 450 |
| Feeling | | |
| Immediately after treatment | Very soft | Soft |
| After laundering | Very soft | Soft |
| After dry cleaning | Very soft | Soft |

[1]Moisture-permeability was measured in accordance with JIS Z 0208.
[2]Waterproofness was measured in accordance with JIS Z 1092.
[3]Laundering was carried out in a household washer using a washing solution containing 1 g/l of a synthetic detergent at a bath ratio of 1:30 at 40° C. for 10 minutes. Thereafter the fabric was rinsed with water at 40° C. for 10 minutes and dried. These procedures were repeated five times.
[4]Dry cleaning was carried out using perchloroethylene containing 0.25% of NEOCOL SW-C and 0.25% of NOIGEN EA-120 (both anionic detergents, sold by DAI-ICHI KOGYO SEIYAKU CO., LTD.) at room temperature for 10 minutes. Thereafter the fabric was rinsed with fresh perchloroethylene and dried. These procedures were repeated three times.

EXAMPLE 2

A polyester taffeta fabric was pre-treated with a water repellent solution as in Example 1.

| | |
|---|---|
| VONCOAT R 3310 (polyacrylate emulsion sold by DAINIPPON INK AND CHEMICALS, INC.) | 50 parts |
| Silicone emulsion (TORAY SILICONE CO., LTD.) | 10 parts |
| 20% aqueous solution of starch | 30 parts |
| ELASGUARD 100 | 5 parts |

was uniformly applied on the fabric as in Example 1 in a coating amount of 50 g/m$^2$ on dry basis. Then the fabric was heat-treated at 120° C. for 3 minutes.

The fabric was immersed in a bath consisting of an aqueous solution containing 0.5% of TERMAMYL 60L (amylase sold by Novo) and 0.5% of NEOCOL SW-C at 50° C. for about 20 minutes. After treating with the enzyme solution, the fabric was soaked in a water bath having a temperature of 80° C. with occasional stirring, washed with water thoroughly and dried. The resulting fabric was subjected to a post-water repellent treatment as in Example 1. Physical properties of the resulting fabric as well as those of control wherein plain water was used instead of the enzyme solution are shown in Table II.

TABLE II

| | Fabric | |
|---|---|---|
| | Treated with enzyme | Treated with plain water |
| Moisture-permeability (g $H_2O/m^2 \cdot 24$ hrs.) | | |
| Immediately after treatment | 4500 | 3000 |
| After laundering | 4200 | 3500 |
| After dry cleaning | 4000 | 3100 |
| Waterproofness (mm $H_2O/cm^2$) | | |

TABLE II-continued

| | Fabric | |
|---|---|---|
| | Treated with enzyme | Treated with plain water |
| Immediately after treatment | 600 | 500 |
| After laundering | 500 | 250 |
| After dry cleaning | 490 | 230 |
| Feeling | | |
| Immediately after treatment | Very soft | Soft |
| After laundering | Very soft | Soft |
| After dry cleaning | Very soft | Soft |

EXAMPLE 3

A cotton broadcloth was pre-treated with a water repellent solution as in Example 1.

A coating liquid having the following composition was prepared.

| | |
|---|---|
| M-2010 | 60 parts |
| POLON MF-6 | 10 parts |
| 20% aqueous solution of FINEGUM SP-1 (CMC sodium sold by DAI-ICHI KOGYO SEIYAKU CO., LTD.) | 30 parts |
| ENZYLON CA-40 (cellulase sold by RAKUTO KASEI KOGYO CO., LTD.) | 0.2 parts |

20 minutes after the preparation thereof, the above coating composition was applied on the fabric as in Example 1, dried at 120° C. for 3 minutes and treated with the same enzyme solution as used in Example 1 in the same manner. The resulting fabric was subjected to a post-water repellent treatment using a 5% aqueous solution of POLON MF-16 (silicone emulsion sold by SHIN-ETSU CHEMICAL CO., LTD.) containing 5% of CAT FZ-31 (catalyst sold by SHIN-ETSU CHEMICAL CO., LTD.).

Physical properties of the resulting fabric as well as those of control wherein plain water was used instead of the enzyme solution are shown in Table III.

TABLE III

| | Fabric | |
|---|---|---|
| | Treated with enzyme | Treated with plain water |
| Moisture-permeability ($g\ H_2O/m^2 \cdot 24$ hrs.) | | |
| Immediately after treatment | 4000 | 3200 |
| After laundering | 4800 | 3300 |
| After dry cleaning | 4500 | 3000 |
| Waterproofness ($mm\ H_2O/cm^2$) | | |
| Immediately after treatment | 500 | 400 |
| After laundering | 450 | 210 |
| After dry cleaning | 400 | 220 |
| Feeling | | |
| Immediately after treatment | Very soft | Soft |
| After laundering | Very soft | Soft |
| After dry cleaning | Very soft | Soft |

What is claimed is:

1. A method for forming a moisture-permeable waterproof coating on a fabric which comprises the steps of applying on a fabric a water-based coating composition containing a film-forming polymer which forms a water insoluble polymeric film upon drying or heat treatment and a water-soluble, enzyme degradable polymer, in a proportion of 5 to 70% by weight of the total solid content of said coating composition, drying or heat-treating said fabric to form a film thereon, treating the resulting film on the fabric with an aqueous solution of an enzyme capable of selectively degrading said water-soluble polymer, thereby enzymatically degrading said water-soluble polymer and extracting the degraded water soluble polymer from said film, whereby the film on the fabric is rendered microporous.

2. The method of claim 1 further including the step of treating the fabric with a water repellent before applying said coating composition.

3. The method of claim 2, wherein said water repellent is a silicone or a fluorocarbon.

4. The method of claim 1, wherein said water-soluble polymer is a water-soluble cellulose derivative and said enzyme is cellulase.

5. The method of claim 1, wherein said water-soluble polmer is starch or a water-soluble derivative thereof and said enzyme is amylase.

6. The method of claim 1, wherein said water-soluble polymer is a water-soluble protein and said enzyme is protease.

7. The method of claim 1, wherein said water-soluble polymer is sodium alginate and said enzyme is alginase.

8. The method of claim 1, wherein the proportion of said water-soluble polymer is 10 to 50% by weight of the total solid content of said coating composition.

9. The method of claim 1, wherein said film-forming polymer is polyurethane, polyacrylate, polyvinyl acetate, silicone, a polymer pressure in a natural or synthetic latex, or a mixture of these polymers.

10. The method of claim 1, wherein the film on the fabric is treated with the enzyme by immersing the fabric in a water bath containing the enzyme.

11. The method of claim 10 further including the step of treating the fabric with a water repellent after immersing in the water bath containing said enzyme.

12. The method of claim 11, wherein said water repellent is a silicone or a fluorocarbon.

13. The method of claim 10, wherein said film-forming polymer is polyurethane, polyacrylate, polyvinyl acetate, silicone, a polymer present in a natural or synthetic latex, silicone or a mixture of these polymers and wherein the proportion of said water-soluble polymer is 10 to 50% by weight of the total solid content of said coating composition and further including the step of treating the fabric with a water repellent after immersing in the water bath containing said enzyme.

14. The method of claim 13, further including the step of treating the fabric with a water repellent before applyiing said coating composition.

15. A method of claim 14, wherein said water repellent is a silicone or a fluorocarbon.

16. The method of claim 14, wherein said water-soluble polymer is a water-soluble cellulose derivative and said enzyme is cellulase.

17. The method of claim 14, wherein said water-soluble polymer is starch or its water-soluble derivative and said enzyme is amylase.

18. The method of claim 14, wherein said water-soluble polymer is a water-soluble protein and said enzyme is protease.

19. The method of claim 14, wherein said water-soluble polymer is sodium alginate and said enzyme is alginase.

20. The method of claim 14, wherein the proportion of said water-soluble polymer is 10 to 50% by weight of the total solid content of said coating composition.

* * * * *